US010809000B2

(12) United States Patent
Iurisci et al.

(10) Patent No.: US 10,809,000 B2
(45) Date of Patent: Oct. 20, 2020

(54) COMPRESSION TRAIN INCLUDING ONE CENTRIFUGAL COMPRESSOR AND LNG PLANT

(71) Applicant: NUOVO PIGNONE TECNOLOGIE-S.r.l., Florence (IT)

(72) Inventors: Giuseppe Iurisci, Florence (IT); Angelo Grimaldi, Florence (IT); Giuseppe Sassanelli, Florence (IT); Marco Formichini, Florence (IT); Antonio Cristallo, Florence (IT); Davide Becherucci, Florence (IT); Dario Matina, Florence (IT)

(73) Assignee: NUOVO PIGNONE TECNOLOGIE SRL, Florence (IT)

( * ) Notice: Subject to any disclaimer, the term of this patent is extended or adjusted under 35 U.S.C. 154(b) by 123 days.

(21) Appl. No.: 15/862,879

(22) Filed: Jan. 5, 2018

(65) Prior Publication Data

US 2018/0209728 A1 Jul. 26, 2018

(30) Foreign Application Priority Data

Jan. 24, 2017 (IT) ..... 102017000007473

(51) Int. Cl.
*F25J 1/00* (2006.01)
*F25J 3/04* (2006.01)
(Continued)

(52) U.S. Cl.
CPC ..... *F25J 3/04145* (2013.01); *F04D 17/122* (2013.01); *F04D 29/5826* (2013.01);
(Continued)

(58) Field of Classification Search
CPC .. F25J 2230/00; F25J 2230/06; F25J 2230/08; F25J 2230/20; F25J 2230/22;
(Continued)

(56) References Cited

U.S. PATENT DOCUMENTS 3,162,519 A * 12/1964 De Lury ..... F25J 1/0022 62/613
4,057,371 A * 11/1977 Pilarczyk ..... F01D 25/166 417/409
(Continued)

FOREIGN PATENT DOCUMENTS

DE 10 2007 029 882 A1 1/2009
FR 2 920 529 A1 3/2009
WO 2009/000415 A2 12/2008

OTHER PUBLICATIONS

Hataya, T., and Horii, N., "The Mitsubishi H-100 Gas Turbine Main Refrigerant Compressor Trains," LNG 18, Perth Australia, pp. 1-15 (Apr. 11-15, 2016).
(Continued)

*Primary Examiner* — Frantz F Jules
*Assistant Examiner* — Erik Mendoza-Wilkenfel
(74) *Attorney, Agent, or Firm* — Baker Hughes Patent Organization

(57) ABSTRACT

Compression train for a natural gas liquefaction process. The compression train includes a driver machine and only one centrifugal compressor machine driven in rotation by the driver machine; the compressor is configured to compress a refrigerant gas with a molecular weight less than 30 g/mol from a suction pressure to a discharge pressure; the ratio between discharge and suction pressures is higher than 10. A LNG plant including a compression train.

18 Claims, 3 Drawing Sheets

(51) Int. Cl.

| | |
|---|---|
| ***F04D 29/58*** | (2006.01) |
| ***F04D 17/12*** | (2006.01) |
| ***F25J 1/02*** | (2006.01) |
| ***F25B 45/00*** | (2006.01) |

(52) U.S. Cl.
CPC ..... *F25B 45/00* (2013.01); *F25J 1/0022* (2013.01); *F25J 1/0052* (2013.01); *F25J 1/0055* (2013.01); *F25J 1/0082* (2013.01); *F25J 1/0085* (2013.01); *F25J 1/0087* (2013.01); *F25J 1/0207* (2013.01); *F25J 1/0216* (2013.01); *F25J 1/0279* (2013.01); *F25J 1/0292* (2013.01); *F25J 3/04127* (2013.01); *F25J 3/04133* (2013.01); *F25J 2220/64* (2013.01); *F25J 2230/20* (2013.01); *F25J 2290/12* (2013.01)

(58) Field of Classification Search
CPC ..... F25J 2230/24; F25J 1/0087; F25J 1/0082; F25J 1/0092; F25J 1/006; F25J 1/0062; F25J 1/007; F25J 1/0072; F25J 1/0075; F25J 1/0077; F25J 2270/12; F25J 2270/14; F25J 2270/60; F25J 2270/66
See application file for complete search history.

(56) References Cited

U.S. PATENT DOCUMENTS 5,087,172 A * 2/1992 Ferri ..... F04D 29/122 277/320
6,340,287 B1 * 1/2002 Eino ..... F04D 29/2222 415/199.1
2010/0251692 A1 * 10/2010 Kinde, Sr. ..... F02K 5/026 60/226.1
2015/0152884 A1 * 6/2015 Guenard ..... F04D 17/122 417/243
2015/0308453 A1 * 10/2015 Nakaniwa ..... F04D 17/122 415/59.1
2016/0102908 A1 * 4/2016 Johnston ..... F25J 1/0249 62/613
2016/0327056 A1 * 11/2016 Nakaniwa ..... F04D 27/0238
2017/0022999 A1 * 1/2017 Peer ..... F04D 29/0516

OTHER PUBLICATIONS

Paradowski, H., "Propane Precooling Cycles for Increased LNG Train Capacity," Retrieved from Internet URL: http://www.ivt.ntnu.no/ept/fag/tep4215/innhold/LNG%20Conferences/2004/Data/Papers-PDF/PS2-3-Paradowski.pdf, on Apr. 20, 2018, vol. 14, pp. PS2-3.1-PS2-3.18 (Mar. 1, 2006).
Pillarella, M., et al., "The C3MR Liquefaction Cycle: Versatility for a Fast Growing, Ever Changing LNG Industry," International Conference And Exhibition On Liquefied Natural, vol. 15, pp. PS2-5.1-PS2-5.14 (May 24, 2007).
Zirn U., "H-100 Adaption for North America Flexible Operation and Single Digit Nox," MHPSA Presentation, Mitsubishi Hitachi Power Systems Americas Inc., pp. 1-20 (Aug. 18-20, 2015).
Iurisci, G., et al., Compression Train Including An Axial Compressor And Lng Plant Including An Axial Compressor, GE Co-Pending Application No. 102015000038051, GE filed on Jul. 24, 2015.
Iurisci, G., et al., Compression Train Including a Centrifugal Compressor and Lng Plant Including a Centrifugal Compressor, GE Co-Pending Application No. 102015000038073, GE filed on Jul. 24, 2015.
Italian Search Report and Written Opinion issued in connection with corresponding IT Application No. 102017000007473 dated Oct. 10, 2017.
Extended European Search Report and Opinion issued in connection with corresponding EP Application No. 18152558.5 dated Mar. 23, 2018.

* cited by examiner

COMPRESSION TRAIN INCLUDING ONE CENTRIFUGAL COMPRESSOR AND LNG PLANT

TECHNICAL FIELD

Embodiments of the subject matter disclosed herein correspond to compression trains including a single centrifugal compressor and LNG (=Liquefied Natural Gas) plants including said compression train.

BACKGROUND OF THE INVENTION

In the field of "Oil & Gas", i.e. machines and plants for exploration, production, storage, refinement and distribution of oil and/or gas, there is always a search for improved solutions.

Improvements may derive from e.g. the structure and/or operation of the machines, the connection of machines, or the combination of machines (for example trains of machines).

Improvements may consist in e.g. increased efficiency and/or reduced losses, increased production and/or decreased wastes, increased functions, reduced cost, reduced size and/or footprint.

Several liquefaction processes for large LNG plants are known in the art:

AP-C3MR® designed by Air Products & Chemicals, Inc. (APCI);

Cascade designed by ConocoPhillips;

AP-X® designed by Air Products & Chemicals, Inc. (APCI);

DMR (=Dual Mixed Refrigerant) of Shell;

SMR (Single Mixed Refrigerant);

MFC® (mixed fluid cascade) designed by Linde;

PRICO® (SMR) designed by Black & Veatch;

Liquefin® designed by Air Liquide.

These known processes are already optimized in term of process but improvements, in particular in terms of number of machines and/or footprint of machines used in an LNG plant are, still sought.

The AP-C3MR® (also called "C3MR") process uses a pure-refrigerant ("C3"), i.e. propane, and a mixed refrigerant ("MR"), i.e. a mixture of typically propane, ethylene, and methane; this process is a 2-cycles liquefaction technology: (one) pure-refrigerant and (one) mixed-refrigerant.

FIG. 1 shows a schematic view of LNG plant according to a AP-C3MR® (hereinafter called simply "C3MR") designed by Air Products & Chemicals. The C3MR is a widely diffused LNG process. The C3MR process consists of two refrigeration cycles: a propane-refrigeration (C3) cycle to cool the natural gas, and mixed refrigerant (MR) cycle to liquefy the natural gas stream.

In the propane refrigeration cycle, the propane is compressed in a single compressor 106 which is driven by a driver 105.

The compressed propane is cooled in a cooler 111 and then, via the line 113, it passes through the exchanger 107 to absorb heat from the natural gas and mixed refrigerant streams. Before the exchanger 107, an expansion of the compressed propane occurs.

In the mixed refrigerant cycle, the mixed refrigerant is compressed through a compression train 100 comprising three compressors 103, 102, 101, arranged in series, driven in rotary by a driver 104. Sometime, the driver 105 of the propane cycle, can be configured to drive one of the three compressors of the mixed refrigerant cycle.

The compressed mixed refrigerant is cooled in a cooler 110 and then, via the line 114, passes through the exchanger 107 wherein it is pre-cooled. Before the exchanger 107, an expansion of the compressed propane occurs.

The low pressure, warm main liquefaction mixed refrigerant can be sent to a sequence of inter-cooled compressors 103, 102, 101 where it is first compressed in compressor 103, cooled in intercooler 115, further compressed in the compressor 102, cooled in intercooler 109, further compressed in compressor 101, and then further cooled in aftercooler 110 to emerge as a high pressure fluid.

The cooled high pressure mixed refrigerant stream can be pre-cooled using heat exchanger 107 resulting in pre-cooled stream. Pre-cooled stream may be separated into lighter refrigerant and heavier refrigerant streams in separator 112. The lighter refrigerant stream may then be condensed and sub-cooled in the main liquefaction exchanger 108. The heavier refrigerant liquid stream may also be sub-cooled in the main liquefaction exchanger 108.

The pre-cooled stream of natural gas is then sent to the cryogenic section of the plant, thus to the main liquefaction exchanger 108, to fully condense and sub-cool vapor stream forming LNG product stream.

The Cascade designed by ConocoPhillips (hereinafter called simply "Cascade") process uses three pure-refrigerants, i.e. typically propane, ethylene or ethane, and methane; this process is a 3-cycles (three) pure-refrigerants liquefaction technology.

It is to be noted that the expression "pure refrigerant" actually means that one substance is predominant (for example, at least 90% or 95% or 98%) in the refrigerant; the substance may be a chemical compound (for example, propane, ethane, ethylene, methane).

FIG. 3 shows a schematic view of LNG plant according to a Cascade process. The Cascade process is, like C3MR, widely diffused.

The Cascade process consists of three refrigeration cycles: a propane refrigeration cycle to pre-cool the natural gas stream, an ethylene refrigeration cycle to cool the pre-cooled natural gas stream, and a methane refrigeration cycle to liquefy the cooled natural gas stream.

In the propane refrigeration cycle, the propane is compressed by means of a compression train 303 comprising two compressors 312, 313 and a driver 306 configured to drive the compressors.

The compressed propane is cooled in a cooler 316 and then it passes through the exchanger 317 to absorb heat from the natural gas, ethylene and methane streams. Before the exchanger 317, an expansion of the compressed propane occurs.

In the ethylene refrigeration cycle, the ethylene is compressed by means of a compression train 302 comprising two compressors 310, 311 and a driver 305 configured to drive the compressors.

The compressed ethylene is cooled in a cooler 315 and in the heat exchanger 317. Then it passes through the exchanger 318 to absorb heat from the natural gas and methane streams. Before the exchanger 318, an expansion of the compressed ethylene occurs.

The heat exchanger 318 may be also used to cool vapors of natural gas separated in separator 320 from the heavier components of the natural gas. The heavier components form natural gas liquefied, which is different from liquefied natural gas.

In the methane refrigeration cycle, the methane is compressed by means of a compression train 301 comprising three compressors 307, 308, 309 and a driver 304 configured to drive the compressors.

The compressed methane is cooled in a cooler 314 and in the heat exchangers 317, 318. Then, it passes through the exchanger 319 to form liquefied natural gas. Before the exchanger 319, an expansion of the compressed methane occurs.

In the field of compressors, it's generally known that compression ratio is proportional to the molecular weight of the process gas under the same boundary conditions.

More the gas is lighter and more is difficult to compress it in a single casing, and several compressors are required to achieve high compression ratio. This problem occurs both in C3MR and Cascade processes with mixed refrigerant, ethylene and methane respectively.

In the state of the art it is not known a compression train having machines able to compress light gases with high compression ratio in medium-large scale LNG plants.

In particular, it is still sought a machine able to compress light refrigerant gases at high compression ratio in a single casing, thus using a single compressor instead of two or more.

In the LNG it is generally known to compress light gases, like mixed refrigerant, ethylene, or methane through two or more compressor machines, due to the low molecular weight of these gases. Consequently, LNG compression train are generally not compact when the processed gas has a small molecular weight.

SUMMARY OF INVENTION

The above identified drawbacks of the prior art are now overcome by the embodiments of the present invention relating to a compression train and a LNG plant.

The compression train for a natural gas liquefaction process can comprise a driver machine and only one centrifugal compressor machine driven in rotation by said driver machine. The compressor can be configured to compress a refrigerant gas with a molecular weight less than 30 g/mol from a suction pressure to a discharge pressure. The ratio between discharge and suction pressures can be higher than 10, in an embodiment, higher than 12, more particularly higher than 15.

The LNG plant can comprise one or more compression trains according to embodiments of the present invention.

Features and embodiments are disclosed here below and are further set forth in the appended claims, which form an integral part of the present description. The above brief description sets forth features of the various embodiments of the present invention in order that the detailed description that follows may be better understood and in order that the present contributions to the art may be better appreciated. There are, of course, other features of embodiments of the invention that will be described hereinafter and which will be set forth in the appended claims. In this respect, before explaining several embodiments of the invention in details, it is understood that the various embodiments of the invention are not limited in their application to the details of the construction and to the arrangements of the components set forth in the following description or illustrated in the drawings. Embodiments of the invention are capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which the disclosure is based, may readily be utilized as a basis for designing other structures, methods, and/or systems for carrying out the several purposes of embodiments of the present invention. It is important, therefore, that the claims be regarded as including such equivalent constructions insofar as they do not depart from the spirit and scope of embodiments of the present invention.

BRIEF DESCRIPTION OF THE DRAWINGS

A more complete appreciation of the disclosed embodiments of the invention and many of the attendant advantages thereof will be readily obtained as the same becomes better understood by reference to the following detailed description when considered in connection with the accompanying drawings, wherein.

DETAILED DESCRIPTION

The following description of exemplary embodiments refers to the accompanying drawings.

The following description does not limit embodiments of the invention. Instead, the scope of the invention is defined by the appended claims.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

In the following (and according to its mathematical meaning) the term "set" means a group of one or more items.

Figure 1:
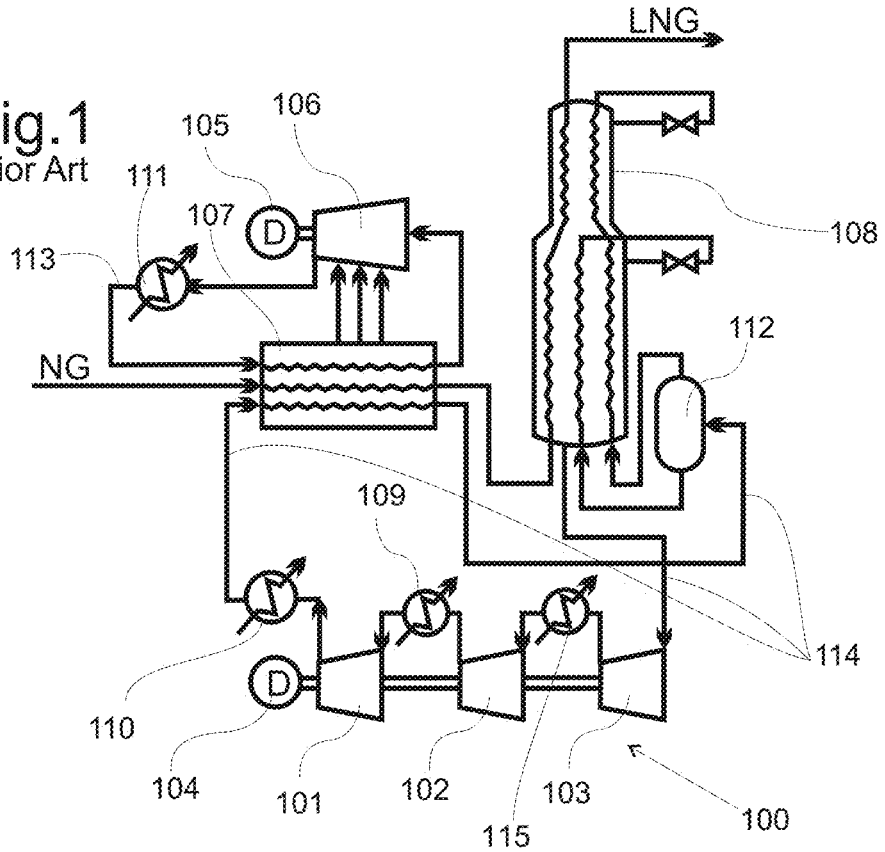
Fig.1 Prior Art
FIG. 1 shows a schematic diagram of a prior art LNG plant according to AP-C3MR® process.
Figure 2:
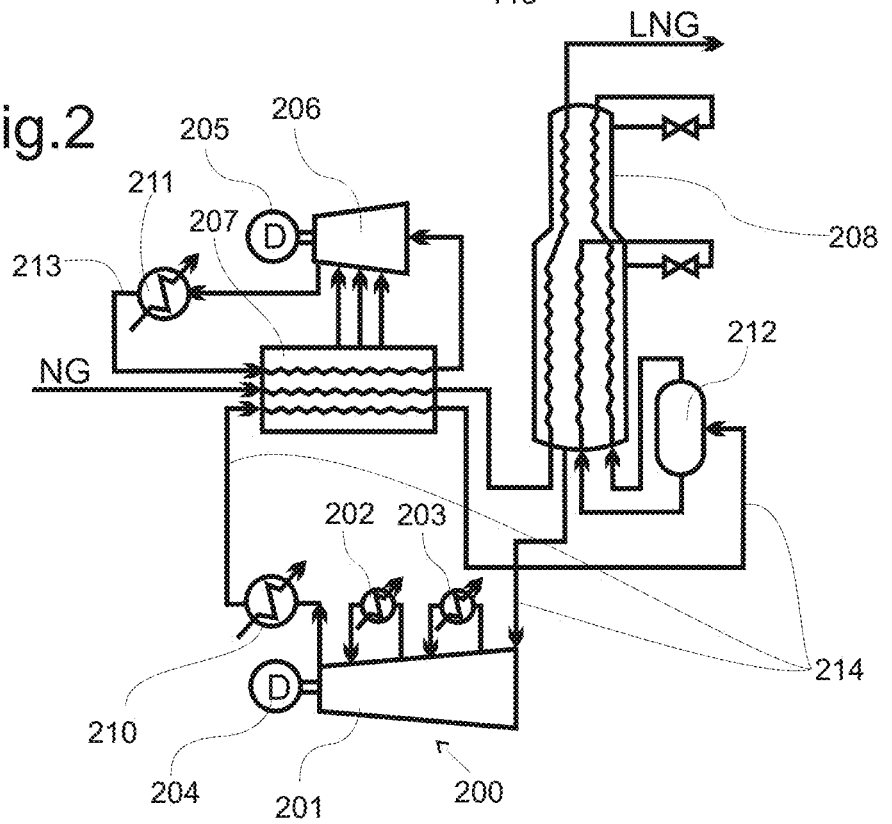
FIG. 2 shows a schematic diagram of a LNG plant according to an embodiment.

With reference to FIG. 2, it is shown a LNG plant according to the C3MR process, as previously described, comprising an embodiment of compression train.

In the propane refrigeration cycle, the propane is compressed in a single compressor 206 which is driven by a driver 205. Driver 205 can be an electrical motor or a gas turbine.

The compressed propane is cooled in a cooler 211 and then, via the line 213, it passes through the exchanger 207 to absorb heat from the natural gas and mixed refrigerant streams. Before the exchanger 207, an expansion of the compressed propane occurs, in an embodiment, with a Joule-Thomson valve (not shown).

In the mixed refrigerant cycle, the mixed refrigerant is compressed by means of a compression train 200 comprising a single compressor 201 and a driver machine 204. Driver machine 204 can be an electrical motor or a gas turbine.

The driver machine 204 can be directly coupled to the single compressor 201.

In a particular embodiment, the compression train 200 can also comprise a gearbox (not shown), arranged between the driver machine 204 and the single compressor 201, configured to increase the rotational speed of driver machine 204. The gearbox can comprise an input shaft mechanically coupled to the driver machine 204 and an output shaft mechanically coupled to the single compressor 201, specifically to the compressor shaft.

After the compression in the single compressor 201, the compressed mixed refrigerant is cooled in a cooler 210 and then, via the line 214, it passes through the exchanger 207, wherein it is pre-cooled. Before the exchanger 207, an expansion of the compressed propane occurs, in an embodiment, with a Joule-Thomson valve (not shown).

The single compressor 201 can be inter-cooled through intercoolers 202, 203 to output mixed refrigerant at high pressure.

In order to obtain the required compression ratio requested by the C3MR process, a specific type of single compressor is used, as will be more clearly understood when the following description is read.

The cooled high pressure mixed refrigerant stream is then pre-cooled using heat exchanger 207 resulting in a pre-cooled stream. Pre-cooled stream may be separated into lighter refrigerant stream and heavier refrigerant streams in separator 212. The lighter refrigerant may then be condensed and sub-cooled in the main liquefaction exchanger 208. The heavier refrigerant liquid stream may also be sub-cooled in the main liquefaction exchanger 208.

The pre-cooled stream of natural gas is then sent to the cryogenic section of the plant, thus to the main liquefaction exchanger 208, to fully condense and sub-cool vapor stream, and to form LNG product stream.

According to the well-known SplitMR® arrangement designed by Air Products & Chemicals Inc., the compression train of the propane can comprise one of the three compressors of the mixed refrigerant. In an embodiment, a revamping method of an existing SplitMR® LNG plant is provided, wherein the mixed refrigerant is compressed by means of a compression train according to embodiments of the present invention, and the compression train of the propane can comprise a driver, a compressor configured to compress the propane and an electric generator configured to convert in electric power the available extra power produced by the driver.

Figure 4:
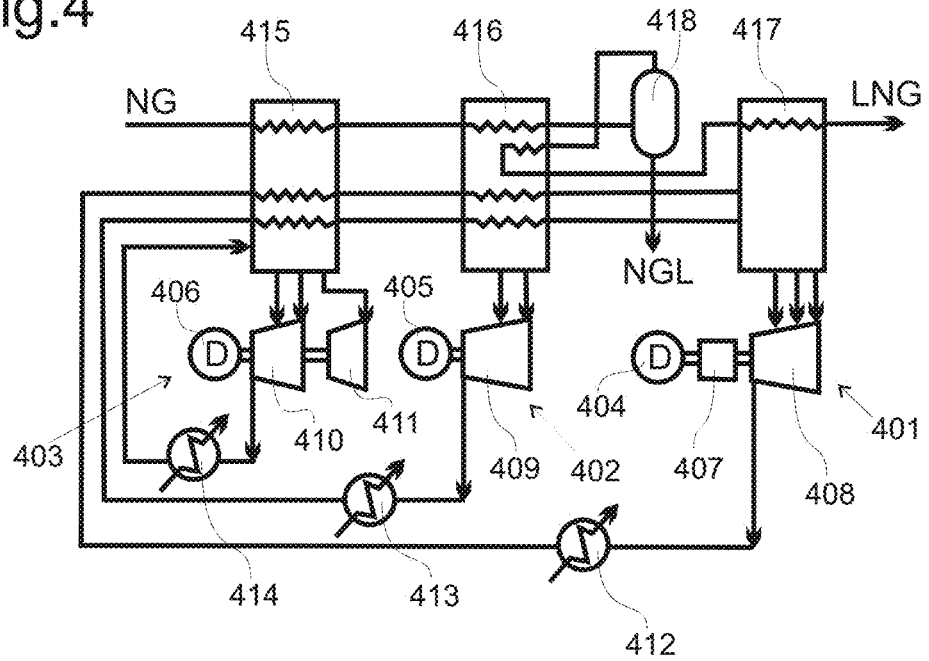
FIG. 4 shows a schematic diagram of a LNG plant according to an embodiment.

With reference to FIG. 4, it is shown a LNG plant according to Cascade process, as previously described, comprising compression trains according to further embodiments of the present invention.

In the propane refrigeration cycle, the propane is compressed by means of a compression train 403 comprising two compressors 410, 411 and a driver 406 configured to drive the compressors. Driver 406 can be an electrical motor or a gas turbine.

The compressed propane is cooled in a cooler 414 and then it passes through the first exchanger 415 to absorb heat from the natural gas, ethylene and methane streams. Before the exchanger 415, an expansion of the compressed propane occurs, in an embodiment, with a Joule-Thomson valve (not shown).

In the ethylene refrigeration cycle, the ethylene is compressed by means of a first compression train 402 comprising a first single compressor 409 and a first driver machine 405 configured to drive in rotation the single compressor 409. Driver machine 405 can be an electrical motor or a gas turbine.

The driver machine 405 is directly-connected to the first compressor 409 through a direct connection. The direct connection can be of type flexible or rigid, depending on the specific operating context.

The compressed ethylene is cooled in a cooler 413 and in the first heat exchanger 415. Then, the ethylene stream passes through the second heat exchanger 416 to absorb heat from the natural gas and methane streams. Before the second heat exchanger 416, an expansion of the compressed ethylene occurs, in an embodiment, with a Joule-Thomson valve (not shown).

The second heat exchanger 416 may be also used to cool vapors of natural gas separated from the heavier components of the natural gas in separator 418. The heavier components form natural gas liquefied.

In the methane refrigeration cycle, the methane is compressed by means of a second compression train 401 comprising a second single compressor 408 and a second driver machine 404 configured to drive in rotation the second single compressor 408. Second driver machine 404 can be an electrical motor or a gas turbine.

The second driver machine 404 and the second single compressor 408 are mechanically connected through a gearbox 407 configured to increase the rotation speed of the second driver machine 404. The gearbox 407 can comprise an input shaft mechanically coupled to the second driver machine 404 and an output shaft mechanically coupled to the shaft of the second single compressor 408.

The compressed methane is cooled in a cooler 412 and in the first and second heat exchangers 415, 416. Then, the methane passes through a third heat exchanger 417 to absorb heat from the cooled natural gas. The stream of natural gas is thus fully condensed and a LNG product stream is achieved. Before the exchanger 417, an expansion of the compressed methane occurs.

With reference to the embodiments, the compressor of said compression train 200, first compression train 402 and second compression train 401, can be of type described hereinafter.

Figure 5:
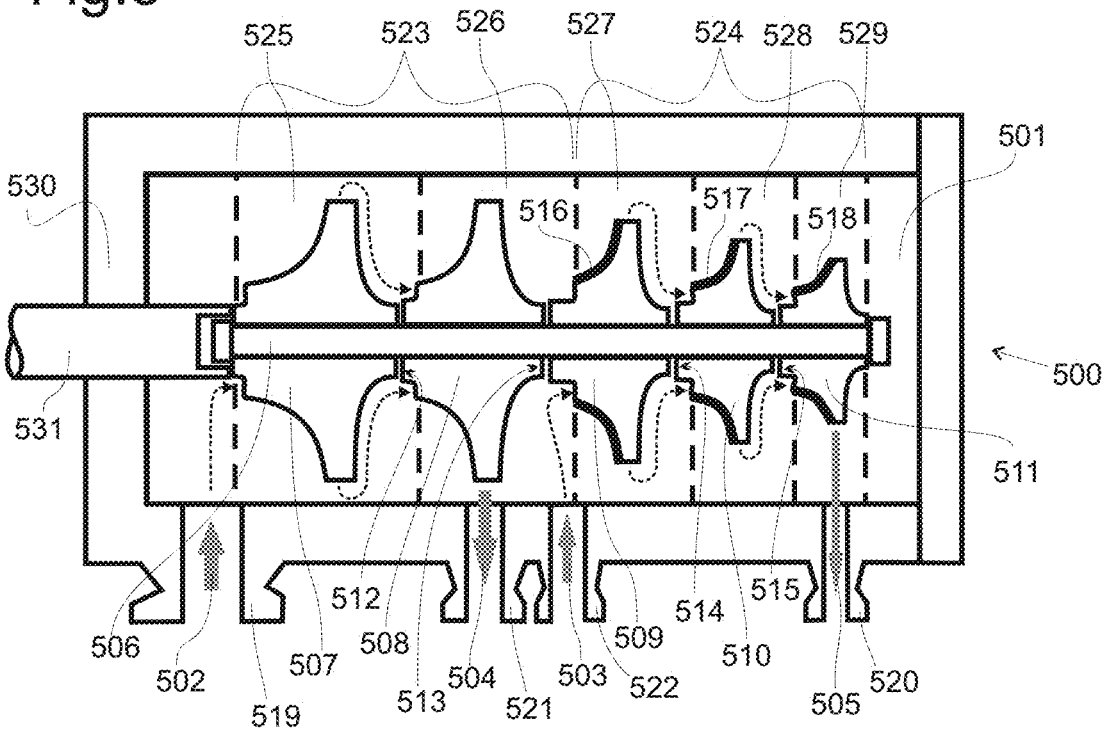
FIG. 5 shows a schematic view of a high compression ratio compressor.

With further reference to FIG. 5, the centrifugal compressor 500 compresses a refrigerant gas from a suction pressure at the main inlet 519 to a discharge pressure at the main outlet 520. The compressor 500 is configured to compress the refrigerant gas with a ratio between said discharge and suction pressures higher than 10, in an embodiment higher than 12, more particularly higher than 15. In embodiments of the present invention, the term "high compression ratio" means a ratio between the outlet and inlet pressures as described hereabove.

The compression ratio required by the C3MR and Cascade processes is considered as a high compression ratio, especially when it is performed by a single compressor compressing a light gas refrigerant.

The compressor 500 is thus configured to compress refrigerant gases having molecular weight less than 30 g/mol.

In embodiments of the present invention, the terms "light refrigerant/s", "light gas/es", "low molecular weight gases" refer to all refrigerant gases, thus all gases used in refrigeration processes, having molecular weight less than 30 g/mol.

The compressor 500 is a centrifugal compressor and, in order to compress light refrigerants with high compression ratio, it can comprise two or three, even four, sections of compression. Each section of compression can comprise one or more compression stages. Each compression stage can comprise a centrifugal impeller, a diffuser and a return channel. The diffuser and/or the return channel are part of the stationary part of the compressor and can include vanes. All impellers are connected together to form the rotor.

Part of the rotor can be the shaft 531. Alternatively, the shaft 531 can be firmly connected to the rotor. The shaft 531 is mechanically connected to the driver machine (not shown in FIG. 5).

Each section of compression has its own inlet and outlet. Therefore, the compressor can comprise two or more inlets, one main inlet and one or more auxiliary inlets, and two or more outlets, one main outlet and one or more auxiliary outlets. With reference to FIG. 5, it's shown a compressor 500 having two section of compressions 523, 524 arranged in series. The first section of compression comprises an inlet 519 and an outlet 521 and two compression stages 525, 526, each one comprising an impeller 507, 508. The second section of compression comprises an inlet 522 and an outlet 520 and three compression stages 527, 528, 529, each one comprising one impeller 509, 510, 511. The refrigerant gas enters through the main inlet 519 (arrow 502), is compressed by the first section of compression 523 and exits from the auxiliary outlet 521 (arrow 504). After an intercooling step, the compressed and cooled refrigerant gas enters again in the compressor, through the auxiliary inlet 522. The refrigerant gas is then compressed in the second section of compression 524 and exits definitively through the main outlet 520.

Each section of compression is configured to compress the refrigerant gas under certain conditions, for example from a specific inlet pressure to a specific outlet pressure between an intercooling stage.

The auxiliary inlet/s and/or auxiliary outlet/s enable the compressor to be more flexible and to adapt the operative conditions of the machine to the process where the compressor is used. For example, the auxiliary inlet/s and auxiliary outlet/s may be used to extract working fluid from the compressor and refrigerate it before being reinjected For example, with reference to FIG. 4, the ethylene compressor, thus the first single compressor 409 of the first compression train 402, comprises two inlet streams like those of compressor 500 of FIG. 5. Between the outlet 504 of the first section of compression and the inlet 503 of the second section of compression, the refrigerant gas is intercooled (intercooling not shown).

Figure 3:
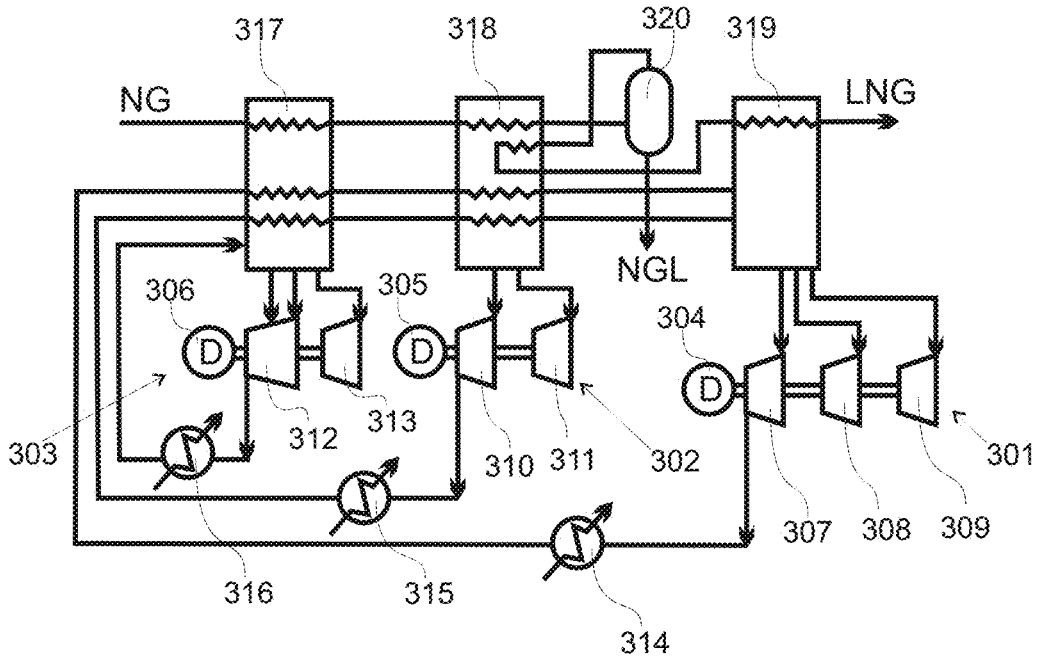
Fig.3 Prior Art
FIG. 3 shows a schematic diagram of a prior art LNG plant according to Cascade process.

Each section of compression resembles, from a compression point of view, to an independent compressor like those labeled 310 and 311 in the FIG. 3. One important technical difference is that all sections of compression are arranged in a common compressor machine having a single casing.

All sections of compression 523, 524 of the centrifugal compressor 500 are arranged in a common bundle 501 which is configured to be removably insertable in a single common casing 530. The rotor and stationary parts are assembled together in a cylindrical bundle that, like a cartridge, is configured to be reversibly axially inserted through one end of the casing 530 in the casing 530 itself. The opposite side of the compressor with respect to the driver machine is normally free of obstacles, and consequently the extraction of the bundle for maintenance activities is facilitated.

The outlet of a section of compression is directly or indirectly fluidly coupled to the inlet of the section of compression arranged downstream.

All sections of compression are arranged to compress the same type of refrigerant gas.

If the sections of compression are two, like in the compressor of FIG. 5, the outlet 521 of the first section of compression 523 is fluidly connected to inlet 522 of the more downstream section of compression, thus the second section of compression 524.

The inlet and outlet of subsequent sections of compression can be fluidly connected through an intercooling section, wherein the refrigerant gas, compressed by a more upstream section, is cooled before re-entry in the subsequent section.

The same concept applies when the sections of compression are three instead of two. Thus, when the third section is arranged downstream the second section, which in turn is arranged downstream the first section, and the outlet of the first section is directly or indirectly fluidly connected to the inlet of the second section of compression and the outlet of the second section is directly or indirectly fluidly connected to the inlet of the third section.

At least one section of compression can be arranged back-to-back. In this case, the outlet of two neighbor sections are arranged next to each other.

Neighbor sections of compression can be separated by means of labyrinth or abradable seals in order to limit leakages from one section to the other.

In particular, the axial length of these seals can be comprised between 30% and 40%, in an embodiment, about 35%, of the average diameter of impellers of said neighbor sections of compression. This range of value guarantees that leakages are highly reduced.

The rotor of the compressor 500 comprises a plurality of impellers, arranged in a plurality of sections of compression as previously described, and the impellers have constant or decreasing diameters, while the last impeller is always smaller than the first one. For example, the first impeller 507 can have a diameter equal to that of the second impeller 508, which in turn has a diameter larger than that of the third impeller 509; while the third, fourth and fifth impellers 509, 510, 511 have diameters which progressively decrease.

All the impellers can be stacked one on the other to form the rotor. A common tie rod 506 can be arranged and configured to maintain all the impellers 507, 508, 509, 510, 511 grouped together. A mutual slippage of neighbor impellers is avoided by means of Hirth connections 512, 513, 514, 515. Opposite axial ends of the impellers comprise Hirth joints. The stacked and coupled impellers are tightened together by means of the tie rod. In this way, a very stable and reliable mechanical connection is achieved. The tie rod can be axially pre-loaded in order to compress the impellers. Each impeller 507, 508, 509, 510, 511 can have a passing hole at its rotational axis and can be configured so that the tie rod can pass through it.

The impellers of the centrifugal compressor of embodiments of the present invention are configured to have a peripheral Mach number smaller than 1,1, in an embodiment, smaller than 1, thus subsonic.

The Mach number (Ma) is normally calculated by the following formula:

$$Ma = \frac{\pi \cdot RPM \cdot \text{Tip Diameter}}{60 \cdot C} \quad (1)$$

where RPM is the Revolutions Per Minute of the impeller, $\pi$=3.14159, Tip Diameter is the diameter of the impeller at tip, and C=Velocity of sound that using the ideal gas equation can be as calculated by the following formula:

$$C = \sqrt{\frac{\gamma \cdot R \cdot T \cdot Z}{MW}} \quad (2)$$

where γ is the Adiabatic exponent of the low molecular weight gas, R is the Universal Gas constant (8.314 J/Mol K), Z is the compressibility factor, T is the Temperature of low molecular weight gas at any point within the compressor, and MW is the Molecular weight of low molecular weight gas.

The velocity of sound (C) varies inversely with the square root of the molecular weight of the fluid. Therefore, lower molecular weight refrigerants give rise to high sonic velocities.

The present centrifugal compressor is configured to process in a single casing low molecular weight gases, like mixed refrigerant of C3MR process, or ethylene and methane of Cascade process: mixed refrigerant of C3MR has a molecule weight of about 26 gr/mol, ethylene has a molecular weight of 28 gr/mol and methane has a molecular weight of 16 gr/mol.

The present compressor is configured to rotate to a high rotational speed, in an embodiment, between 3.600 and 8.000 rpm, being the molecular weight of the processed refrigerant gas lower than 30 g/mol. These features allow to maintain the impellers in sub-sonic operating conditions.

At least one of the impeller of the centrifugal compressor has a peripheral speed over 300 m/s, in an embodiment, over 380 m/s.

In an embodiment, the most upstream impeller/s can be of the open type, that means without shroud. On the contrary the other impellers, thus those arranged downstream the first group of open impeller/s, can comprise shrouds 516, 517, 518.

The most upstream impeller/s have high peripheral speed/s with respect to the other impellers and consequently larger diameter/s. For this reason, the most upstream impellers can be unshrouded for avoiding mechanical stresses. The average diameter of first two impellers can be higher than 1.2 times of the average diameter of the other impellers. Unshrouded impellers can rotate faster than shrouded impellers, due to the absence of the shroud; in fact, when the impeller rotates the shroud is pull outwardly by the centrifugal force acting on it and over a certain rotary speed the shroud risks to pull out the impeller.

Thanks to the rotor configuration of the compressor defined above, the impeller can rotate faster than traditional centrifugal compressors thus achieving a greater compression ratio.

In one embodiment, the portion of the casing arranged around the inlet and/or outlet mouth/s has a greater thickness with respect to the average thickness of the rest of the casing, in order to strengthen the casing of the compressor in the zone of the compressor widely stressed by the high pressure.

The driver machine of the compression train according to any embodiment of the present invention can be a single-shaft gas turbine, a multi-shaft gas turbine, or a steam turbine. In a further embodiment, the driver machine can be variable-speed drive (VSD) electric motor, or a fixed-speed electric motor.

Due to technical features of the present centrifugal compressor, the couple of traditional centrifugal compressors 310, 311 used to compress ethylene in the Cascade process can now be substituted by a single compressor 409 as previously described.

Due to the same reasons, the three traditional centrifugal compressors 307, 308, 309 used to compress methane in the Cascade process can now be substituted by a further single compressor 408 as previously described.

Furthermore, for the same disclosed technical reasons, the three traditional centrifugal compressors 101, 102, 103 used to compress the mixed refrigerant in the C3MR process, can now be substituted by a single compressor 201 as previously described.

The compression previously performed by more than one compressors can now be performed with a single compressor according to embodiments of the present invention without compromising the overall performances. Evident advantages are so achieved.

The compression train so provided doesn't required any further compressor connected directly/indirectly to the driver machine.

By using compression train/s with compressor/s according to embodiments of the present invention, a higher LNG production may be obtained in a smaller space and/or in a smaller footprint and with a lesser number of machines.

It is to be noted that having only one case instead of two or more cases is advantageous from many points of view:

it simplifies installation and maintenance, it reduces maintenance time, it increases reliability (less components and less likelihood of failure), it reduces footprint and weight of machines, it reduces leakages of gases, it reduces the complexity and size of the lubricant oil system.

Even if the present compression train has been adapted and described for C3MR and Cascade processes, it can be easily adapted and used for other LNG processes.

While the disclosed embodiments of the subject matter described herein have been shown in the drawings and fully described above with particularity and detail in connection with several exemplary embodiments, it will be apparent to those of ordinary skill in the art that many modifications, changes, and omissions are possible with-out materially departing from the novel teachings, the principles and concepts set forth herein, and advantages of the subject matter recited in the appended claims. Hence, the proper scope of the disclosed innovations should be determined only by the broadest interpretation of the appended claims so as to encompass all such modifications, changes, and omissions. In addition, the order or sequence of any process or method steps may be varied or re-sequenced according to alternative embodiments.

Another embodiments of the present invention is a compression train comprising an engine and a high speed compressor driven by the engine; wherein the high speed compressor is a centrifugal compressor and comprises a first set of impellers and a second set of impellers arranged downstream or upstream the first set of impellers; the impellers of the first set being centrifugal and unshrouded; the impellers of the second set being centrifugal and shrouded; at least the impellers of the first set and of the second set being housed inside one common casing; the impellers of the first set and of the second set being coupled to each other through mechanical connections. In one embodiment, the engine may an electric motor or a steam turbine or a gas turbine, in particular an aeroderivative gas turbine. In another embodiment, the engine and the high speed compressor are connected directly or through a gear box. In an embodiment, the compression comprises a further centrifugal compressor arranged between the engine and the high speed compressor. In one embodiment, the gear box is arranged between the high speed compressor and the further compressor. On another embodiment, the compression train comprises a helper motor configured to help the main engine when the power absorbed by the compressor/s exceeds a predetermined threshold.

This written description uses examples to disclose the invention, including the preferred embodiments, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A compression train for a natural gas liquefaction process, the compressor train comprising:

a driver machine;

a single centrifugal compressor machine driven in rotation by the driver machine, the compressor machine comprising a single casing, at least two sections of compression housed inside the single casing, a main inlet passage configured to receive a refrigerant gas to be compressed by one of the at least two sections of compression, an auxiliary outlet configured to discharge the refrigerant gas compressed by the one of the at least two sections of compression from the compressor machine, an auxiliary inlet configured to receive the refrigerant gas, having been compressed by the one of the at least two sections of compression and subsequently externally cooled, to be further compressed by another of the at least two sections of compression, and a main outlet configured to discharge the refrigerant gas having been further compressed by the another of the at least two sections of compression from the compressor machine, wherein the compressor machine is configured to compress a refrigerant gas with a molecular weight less than 30 g/mol from a suction pressure to a discharge pressure, the ratio between discharge pressure at the main outlet and suction pressures at the main inlet is higher than 10, and each section of the at least two sections of compression comprises a respective two or more compression stages.

2. The compression train according to claim 1, wherein the driver machine and the compressor machine are mechanically direct-connected each other.

3. The compression train according to claim 1, wherein the driver machine and the compressor machine are connected to each other by a gear-box.

4. The compression train according to claim 1, wherein the compressor machine is of barrel-type and the two or more sections of compression are arranged in a common bundle removably insertable the single casing.

5. The compression train according to claim 1, wherein the compressor machine comprises a respective inlet and a respective outlet for each section of the two or more sections of compression.

6. The compression train according to claim 1, wherein there are two sections of compression housed inside the single casing, a first section in fluid communication with the main inlet and the auxiliary outlet, and a second section in fluid communication with the auxiliary inlet and the main outlet, and the auxiliary outlet is directly or indirectly in fluid communication with auxiliary input.

7. The compression train according to claim 1, wherein the driver machine is a single-shaft gas turbine or a multi-shaft gas turbine or an electric motor.

8. The compression train according to claim 1, wherein the refrigerant gas is mixed refrigerant and the natural gas liquefaction process is of the type AP-C3MR®.

9. The compression train according to claim 1, wherein the refrigerant is ethylene or methane and the natural gas liquefaction process is a Cascade type.

10. The compression train according to claim 1 wherein the gas refrigerant passes through an intercooler arranged in a fluid path between the auxiliary outlet and the auxiliary inlet.

11. The compression train according to claim 1, wherein each of the two or more sections of compression comprises a respective impeller and the respective impeller of one of the two or more sections of compression has a smaller diameter than a diameter of the respective impeller of at least one other of the two or more sections of compression.

12. The compression train according to claim 11, wherein the respective impeller of at least one of the two or more sections of compression is an open type impeller and the respective impeller of at least one other of the two or more sections of compression is a closed type impeller.

13. The compression train according to claim 11, wherein the impellers associated with the two or more sections of compression are stacked one on the other to form a rotor.

14. The compression train according to claim 11, wherein a peripheral Mach number of the respective impeller of each of the two or more sections of compression is smaller than 1.

15. The compression train according to claim 11, wherein at least one impeller has a peripheral speed over 300 m/s.

16. The compression train according to claim 11, wherein a labyrinth or abradable seal is provided between adjacent sections of the two or more sections of compression, and an axial length of the labyrinth or abradable seal is between 30% and 40% of an average diameter of the respective impellers of each of the adjacent sections of the two or more sections of compression.

17. The compression train according to claim 6, wherein the compressor machine comprises a respective inlet and a respective outlet for each section of the two or more sections of compression wherein the respective inlet of each of the two or more sections of compression defines a mouth and the respective outlet of each of the two or more sections of compression defines a mouth, and the single compressor casing has an average thickness less than a thickness of the single compressor casing around the mouths of the respective inlets and outlets of the two or more sections of compression.

18. An LNG plant comprising one or more compression train according to claim 1.

* * * * *